US005351505A

United States Patent [19]

Febrer

[11] Patent Number: 5,351,505

[45] Date of Patent: Oct. 4, 1994

[54] FASTENER FOR JEWELRY

[75] Inventor: Antonio A. Febrer, Manacor, Spain

[73] Assignee: Perlas Manacor, S.A., Manacor, Spain

[21] Appl. No.: 1,789

[22] Filed: Jan. 8, 1993

[30] Foreign Application Priority Data

Jun. 25, 1992 [ES] Spain ..... 9202007[U]

[51] Int. Cl.[5] ..... A44B 13/02

[52] U.S. Cl. ..... 63/2; 24/600.5

[58] Field of Search ..... 63/2, 3, 4; 24/600.4, 24/600.5, 600.6, 600.7

[56] References Cited

U.S. PATENT DOCUMENTS

| | | | |
|---|---|---|---|
| 1,071,131 | 8/1913 | Barney | 63/4 |
| 1,396,588 | 11/1921 | Nittel | 24/600.6 |
| 1,599,112 | 9/1926 | Boots | 24/600.5 |
| 1,644,562 | 10/1927 | Browning | 24/600.6 |
| 2,015,616 | 9/1935 | Clark | 20/600.6 |
| 4,665,595 | 5/1987 | Viot | 63/2 |

FOREIGN PATENT DOCUMENTS

| | | | |
|---|---|---|---|
| 213881 | 9/1957 | Australia | 63/2 |
| 1900451 | 8/1970 | Fed. Rep. of Germany | 24/600.5 |
| 2343440 | 10/1977 | France | 24/600.5 |

*Primary Examiner*—Flemming Saether
*Attorney, Agent, or Firm*—Michael J. Striker

[57] ABSTRACT

A fastener for jewelry has a bottom body having a stud forming a male part, a safety disc movable relative to the bottom body between an open position in which it leaves a space between the stud and the safety disc and a closed position in which the space is not provided, a spring urging the safety disc to the closed position so that for displacing the safety disc from the closed position to the open position the safety disc has to be displaced against a force of the spring, and a female member connectable with the article of jewelry and placeable on the stud in the open position so that in the closed position the female member cannot be withdrawn from the stud.

14 Claims, 2 Drawing Sheets

FASTENER FOR JEWELRY

BACKGROUND OF THE INVENTION

The present invention relates to a fastener for bracelets, necklaces and other jewelry and costume jewelry items.

The jewelry and custom jewelry industry use fasteners of several models. All models are generally based on the same construction and operation principle in that male and female components having different shapes are provided, and suitable auxiliary elements guarantee their mutual locking. It has been shown that in practice they are not always reliable since their parts loose their basic characteristics, such as for example such parts as spring. As a result, an unauthorized opening of the fastener can occur.

SUMMARY OF THE INVENTION

Accordingly, it is an object of the present invention to provide a fastener for jewelry of the above mentioned general type, which avoids the disadvantages of the prior art.

In keeping with these objects and with others which will become apparent hereinafter, one feature of the present invention resides, briefly stated, in jewelry fastener of a groove-tongue type, in which a female element and male element assembled with one another remain fully and perfectly connected by a fastening and detracting element moveable against a force of an inner spring to allow a female component to be withdrawn, while during use they remain in closed condition so that components of the fastener are concealed and the fastener has a desired appearance and continuity.

In accordance with the present invention it is achieved in that the fastener has a bottom body having a stud forming a male part, a safety disc movable relative to the bottom body between an open position in which it leaves a space between the stud and the safety disc and a closed position in which the space is not provided, spring means urging the safety disc to the closed position so that for displacing the safety disc from the closed position to the open position the safety disc has to be displaced against a force of the spring means, and a female member connectable with the article of jewelry and placeable on the stud in the open position so that in the closed position the female member cannot be withdrawn from the stud.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
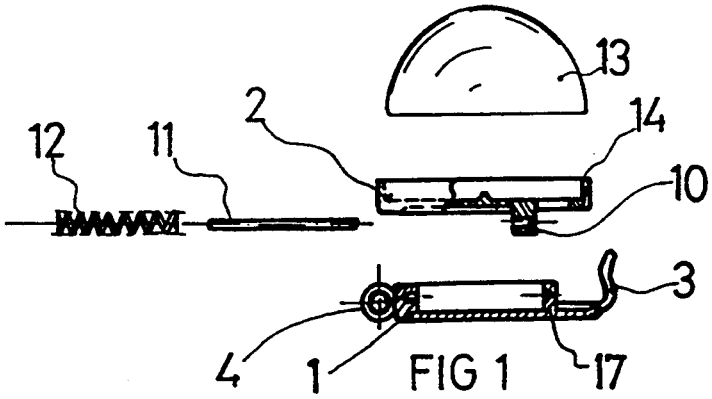
FIG. 1 is an exploded partially sectioned side view of a fastener in accordance with the present invention.
Figure 2:
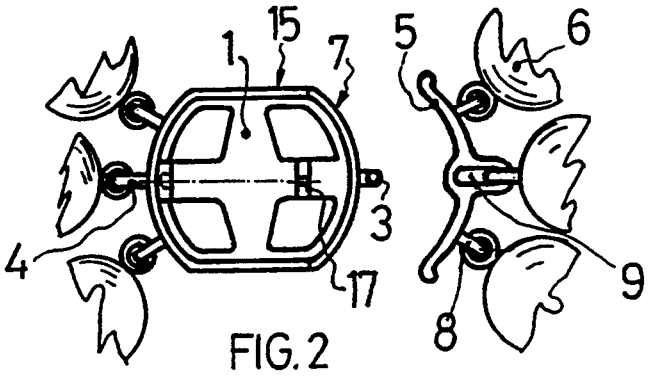
FIG. 2 is a plan view of a bottom of the fastener in accordance with the present invention shown in FIG. 1.

A fastener for jewelry in accordance with the present invention has a bottom body which is identified with reference numeral 1 and is cup-shaped. A mechanism which allow the displacement of a safety circular disc 2 is accommodated in the interior of the bottom body 1. A front face of the bottom body is provided with a stud 3, while a back side of the bottom body is provided with several rings 4. A female part 5 of the fastener can be anchored on the stud 4 which acts as a male part of the fastener. Pearl strings or analogous jewelry elements 6 which form a bracelet or a necklace can be fixed on the back rings 4. In the drawing the article of jewelry is shown as a three-string article.

Figure 3:
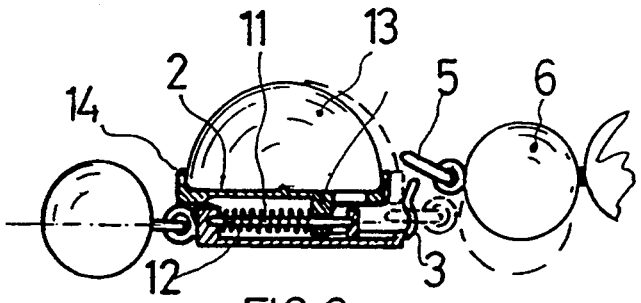
FIG. 3 is a side view of the inventive fastener in an assembled condition.
Figure 4:
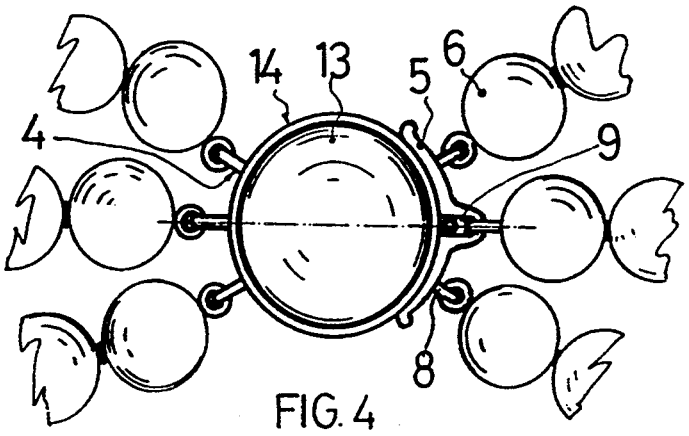
FIG. 4 is a plan view of the fastener in the assembled condition shown in FIG. 3.
Figure 5:
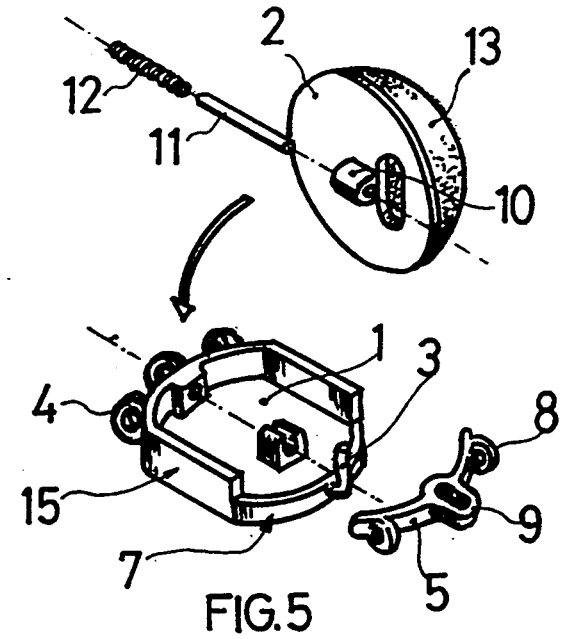
FIG. 5 is an exploded perspective view of a partly dismounted fastener in accordance with the present invention.
Figure 6:
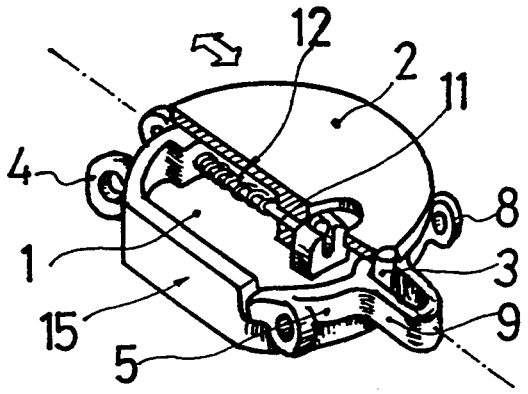
FIG. 6 is a perspective and partially sectioned view of the fastener.

The female part 5 of the fastener has a shape similar to the shape of a largely curved fork corresponding to a front area 7 of the bottom body 1. Therefore as shown in FIG. 3 when it is hooked to the stud 3, it abuts against the front area of the bottom body over a surface. The female part 5 has a back side provided with rings 8. The other end of the pearl string or similar jewelry elements 6 can be fixed to the rings 8. The central string is fixed in a notch 9 of the female part 5. The notch 9 is fitted on the stud 3.

The safety disc 2 is positioned on the bottom body 1. At its lower part it is provided with a support 10, and a guiding shaft 11 extends through the support 10 so that the disc can displace axially backwards on the shaft against the force of a cylindrical spring 12. The spring 12 is also arranged on the guiding shaft 11 and applies the force to the lower support 10 so as to hold the disc 2 in its fastened advanced position shown in a broken line in FIG. 3. Therefore the female part 5 of the fastener cannot be withdrawn from the stud 3 in unauthorized manner.

When a user presses the safety disc 2 backwards, the resistance of the spring 12 is overcome and the disc 2 is displaced backwards so that the female part 5 of the fastener can be detached from the stud 3. The guiding shaft 11 remains axially locked in the bottom body 1, and particularly in its back wall and its front support 17.

An element 13 having a semi-spherical shape or another shape is arranged on the safety disc 2. Preferably it is composed of a material and has an external appearance corresponding to those of one of the spheres which form the strings 6. The element 13 is received in a recess formed by a rim 14 of the safety disc 2 and is locked in the recess.

In order to use the article of jewelry, a user moves the disc 2 backwards by applying a pressure to the element 13, and the disc 2 is displaced being guided on the shaft 11 and supported on side walls 15 of the bottom body 1, so as to overcome the resistance of the spring 12. The space around the stud 3 therefore becomes free and the notch 9 of the female part 5 can be hooked on the stud 3.

When the user stops applying pressure to the element 11 the safety disc 2 is moved to its initial position under the action of the spring 12, so that the female part is completely covered and fixed on the stud 3. As a result, the stability of the fastener is guaranteed and the female element cannot be incidentally or unintentionally withdrawn from the stud.

Figure 7:
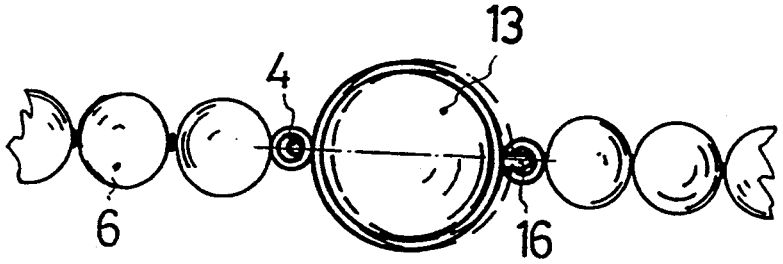
FIG. 7 is a view showing another embodiment of the present invention with the inventive fastener used for a simple bracelet or necklace.

As shown in FIG. 7, the fastener can be specifically designed for bracelets, necklaces and other articles of jewelry having a single string of pearls or similar jewelry elements. In this construction the bottom body has only one ring 4 at its lower part to lock the single string of pearls 6. The female part is formed as a simple ring 16 which is hooked on the stud 3.

The fastener designed in accordance with the present invention has a simple construction, provides for reliable fastening of the article of jewelry, and is convenient in operation for obtaining opening and closing conditions.

It will be understood that each of the elements described above, or two or more together, may also find a useful application in other types of constructions differing from the types described above.

While the invention has been illustrated and described as embodied in a fastener for jewelry, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A fastener for jewelry, comprising a bottom body having a stud forming a male part; a safety disc movable relative to said bottom body between an open position in which a space is between said stud and said safety disc and a closed position in which said space is not provided; spring means urging said safety disc to said closed position so that for displacing said safety disc from said closed position to said open position said safety disc has to be displaced against a force of said spring means; a female member placeable on said stud in said open position so that in said closed position said female member cannot be withdrawn from said stud; a guiding shaft on which said safety disc is moveable in said open and said closed positions; and a support formed as a projection extending from a surface of said safety disc which faces said closing body and arranged so that said guiding shaft extends through said projection of said safety disc and is guided in said projection of said safety disc so as to guide said safety disc during its movement between said open and said closed positions.

2. Fastener as defined in claim 1; and further comprising a guiding shaft on which said safety disc is moveable between said open and said closed positions, said spring means including a spring arranged on said shaft.

3. Fastener as defined in claim 1, wherein said bottom body and said female member have opposite back sides; and further comprising rings provided on said back sides of said bottom body and said female member and connectable to ends of an article of jewelry.

4. Fastener as defined in claim 3, wherein said rings on said back sides of said bottom body and said female member are symmetrical.

5. Fastener as defined in claim 1; and further comprising an ornamental member arranged on said safety disc and having a shape corresponding to a shape of jewelry elements of an article of jewelry provided with the fastener.

6. Fastener as defined in claim 5, wherein said ornamental element is semi-spherical.

7. An article of jewelry, comprising a string of Jewelry elements having two ends; and a fastener releasably connecting said ends of said string with one another, said fastener including a bottom body having a stud forming a male part, a safety disc movable relative to said bottom body between an open position in which a space is between said stud and said safety disc and a closed position in which said space is not provided, spring means urging said safety disc to said closed position so that for displacing said safety disc from said close position to said open position said safety disc has to be displaced against a force of said spring means, and a female member connectable with the article of jewelry and placeable on said stud in said open position so that in said closed position said female member cannot be withdrawn from said stud, a guiding shaft on which said safety disc is movable in said open and said closed positions; and a support formed as a projection extending from a surface of said safety disc faces said closing body and arranged so that said guiding shaft extends through said projection of said safety disc and is guided in said projection of said safety disc so as to guide said safety disc during its movement between said open and said closed positions.

8. An article of jewelry as defined in claim 7, wherein said jewelry elements have a predetermined shape, said fastener further having an ornamental member arranged on said safety disc and having a shape substantially corresponding to the shape of said jewelry elements.

9. An article of jewelry as defined in claim 8, wherein said ornamental member and said jewelry elements have each a semi-spherical surface.

10. A fastener for jewelry, comprising a bottom body having a stud forming a male part; a safety disc movable relative to said bottom body between an open position in which a space is between said stud and said safety disc and a closed position in which said space is not provided; spring means urging said safety disc to said closed position so that for displacing said safety disc from said close position to said open position said safety disc has to be displaced against a force of said spring means; a female member placeable on said stud in said open position so that in said closed position said female member cannot be withdrawn from said stud; and a guiding shaft on which said safety disc is moveable between said open and said closed positions, said spring means including a spring arranged on said shaft, said bottom body having opposite wall faces, the ends of said guiding shaft being fixed in said opposite faces of said bottom body.

11. A fastener for jewelry, comprising a bottom body having a stud forming a male part; a safety disc movable relative to said bottom body between an open position in which a space is between said stud and said safety disc and a closed position in which said space is not provided; spring means urging said safety disc to said closed position so that for displacing said safety disc from said close position to said open position said safety disc has to be displaced against a force of said spring means; and a female member placeable on said stud in said open position so that in said closed position said female member cannot be withdrawn from said stud, said bottom body having a curved front wall face, said female member having a fork-like portion with a curving corresponding to said curved face of said bottom body, said portion further being provided with a female formation for engagement with said stud.

12. Fastener as defined in claim 11, wherein said female formation is a notch provided in said female member.

13. An article of jewelry, comprising a string of jewelry elements having two ends; and a fastener releasebly connecting said ends of said string with on another, said fastener including a bottom body having a stud forming a male part, a safety disc moveable relative to said bottom body between an open position in which a space is between said stud and said safety disc and a closed position in which said space is not provided, spring means urging said safety disc to said closed position so that for displacing said safety disc from said close position to said open position said safety disc has to be displaced against a force of said spring means, a female member connectable with the article of jewelry and placeable on said stud in said open position so that in said closed position said female member cannot be withdrawn from said stud, and a guiding shaft on which said safety disc is moveable between said open and said closed positions, said spring means including a spring arranged on said shaft, said bottom body having opposite wall faces, the ends of said guiding shaft being fixed in said opposite wall faces of said bottom body.

14. An article of jewelry, comprising a string of jewelry elements having two ends; and a fastener releaseably connecting said ends of said string with on another, said fastener including a bottom body having a stud forming a male part, a safety disc movable relative to said bottom body between an open position in which a space is between said stud and said safety disc and a closed position in which said space is not provided, spring means urging said safety disc to said closed position so that for displacing said safety disc from said close position to said open position said safety disc has to be displaced against a force of said spring means, and a female member connectable with the article of jewelry and placeable on said stud in said open position so that in said closed position said female member cannot be withdrawn from said stud, said bottom body having a curved front wall face, said female member having a fork-like portion with a curving corresponding to said curved face of said bottom body, said portion further being provided with a female formation for engagement with said stud.

* * * * *